US005966080A

United States Patent [19]

Bigsby

[11] Patent Number: 5,966,080

[45] Date of Patent: Oct. 12, 1999

[54] DRAIN PLUG WARNING SYSTEM

[75] Inventor: Bryan D. Bigsby, Beaufort, S.C.

[73] Assignee: Brunswick Corporation, Lake Forest, Ill.

[21] Appl. No.: 08/939,344

[22] Filed: Sep. 29, 1997

[51] Int. Cl.[6] ..... G08B 21/06

[52] U.S. Cl. ..... 340/686; 340/687; 340/568; 114/197

[58] Field of Search ..... 340/686, 687, 340/568, 540, 657, 984; 114/197, 270; 116/26, 1, 4, DIG. 1

[56] References Cited

U.S. PATENT DOCUMENTS

| | | | |
|---|---|---|---|
| 2,209,466 | 12/1940 | Miller | 340/568 |
| 3,036,541 | 6/1962 | Musick et al. | 340/568 |
| 3,821,699 | 6/1974 | Marus et al. | 340/686 |
| 3,869,391 | 3/1975 | Kramer | 210/222 |
| 3,896,280 | 7/1975 | Blake | 340/686 |
| 4,516,515 | 5/1985 | Johnson | 116/26 |
| 4,542,373 | 9/1985 | Hillock | 340/568 |
| 4,843,376 | 6/1989 | Wagner et al. | 340/568 |
| 5,047,753 | 9/1991 | Birchfield | 340/686 |
| 5,162,793 | 11/1992 | Plost et al. | 340/686 |
| 5,186,050 | 2/1993 | Legace et al. | 73/187 |

*Primary Examiner*—Nina Tong
*Attorney, Agent, or Firm*—William D. Lanyi

[57] ABSTRACT

A drain plug warning system includes a first member that can be attached to a transom or other wall of a watercraft and a second member that is shaped to be received within an aperture that is formed through the first member. To drain water from the watercraft, the drain plug or second member is removed from the aperture of the first member, and water is allowed to drain through the aperture. If the second member is not replaced within the aperture to a predetermined location relative to the first member, a magnetically sensitive component near the aperture assumes a state that will cause an alarm under certain predefined conditions such as when an operator activates a key switch mechanism of the watercraft. The magnetically sensitive component can be a Hall effect element or other magnetically sensitive component. The actuator in the second member can be a permanent magnet, but other embodiments of the system could utilize a ferromagnetic material in the second member combined with a biasing magnet associated with the magnetically sensitive component near the aperture.

15 Claims, 2 Drawing Sheets

DRAIN PLUG WARNING SYSTEM

BACKGROUND OF THE INVENTION

1. Field of the Invention

The present invention is generally related to a drain plug warning system and, more particularly, to a warning system that provides a magnetically actuated switch that is activated when a removable plug is in its proper location to close an aperture used to drain water from a watercraft.

2. Description of the Prior Art

Many different types of watercraft are provided with drain plugs to empty water from the craft after use. Drain plugs are provided for several types of watercraft, such as boats and personal watercraft. When the drain plug is removed, an aperture is opened through a wall of the watercraft, such as the transom. Typically, the aperture is located near the bottom of the watercraft to allow draining of water from the hull structure.

Unfortunately, an operator can occasionally forget to replace the drain plug prior to reusing the watercraft. If this occurs, water can rush through the opening in the transom when the watercraft is placed into the water. This will flood the hull of the watercraft and can cause it to sink and be subject to severe damage.

U.S. Pat. No. 4,542,373, which issued to Hillock on Sep. 17, 1985, discloses a small craft plug detector. The detector indicates whether a drain plug of a small boat or craft is installed. In one embodiment, a hollow cylindrical housing has upper and lower ends with central openings therethrough. An indicating plunger disposed within the housing has a rod which extends upwardly through the hole in the upper end of the housing and the lower end which extends downwardly through the opening in the lower end of the housing. A spring biases the plunger in an upper direction. Electrical contacts are provided so that an electrical connection may be made to activate a lamp, alarm or the like when the plunger is moved downwardly. A second embodiment utilizes the electrical contacts of the first embodiment but has no central opening in the upper end of the housing, and the plunger has no rod portion extending therethrough. A third embodiment of the invention is similar to the first embodiment but does not include the electrical contacts.

U.S. Pat. No. 5,047,753, which issued to Birchfield on Sep. 10, 1991, describes a drain plug position indicator apparatus. The apparatus includes a plug detector mechanism mounted adjacent an interior surface of a drain plug aperture directed through a transom of a boat. The detecting means includes a spring-biased switch positionable from an extended position in the absence of a plug to a retracted position in the presence of a plug directed through the transom. The switch is cooperative with an audible member to effect alarm in the absence of the plug.

It is clearly beneficial to provide a warning system to indicate that a drain plug is not properly replaced to seal an aperture in the transom. U.S. Pat. No. 5,047,753, described immediately above, discusses several prior patents that also address this problem. Warning systems known by those skilled in the art have provided switches to detect the presence of a drain plug in the aperture through the transom or hull of a watercraft. However, drain plug warning systems known to those skilled in the art have several severe disadvantages. Typically, warning systems use switches with moving parts that can be mechanically jammed or made electrically inoperative because of corrosion. Furthermore, the area within a boat or personal watercraft where the aperture is provided through the transom is particularly subject to the accumulation of sand, seaweed and other types of debris. This accumulation of foreign matter can adversely affect the moving parts of the switches used in drain plug warning systems. It would therefore be significantly beneficial if a drain plug warning system could be provided which detects the absence of a drain plug from its proper position to seal an aperture and, in response, provides an alarm such as a horn when an attempt is made to operate the watercraft without the drain plug in its proper position, and whose mechanisms do not interfere with the flow of water and debris through the aperture.

SUMMARY OF THE INVENTION

A drain plug warning system made in accordance with the present invention comprises a first member attached to the watercraft. The first member, which can be in the form of a bracket, has an aperture formed therethrough. The aperture is placed in an opening through a wall of the watercraft, such as the transom, near the floor or bottom portion of the hull. A second member is provided which is shaped to be received within the aperture of the first member in order to prevent a fluid, such as water, from flowing through the aperture.

The drain plug warning system of the present invention further comprises a magnetically sensitive component disposed proximate the aperture. In addition, an actuator is provided which is attached to the second member for actuating the magnetically sensitive component when the second member is disposed in a predetermined position within the first member.

The actuator, which is attached to the second member, can be a magnet and the magnetically sensitive component disposed proximate the aperture can be a Hall effect element or another component which is responsive to the presence or change in a magnetic field.

The aperture can be threaded with internal threads and the second member, or drain plug, can be threaded with external threads so that the second member is disposable in threaded association within the aperture to place the second member in the predetermined position which actuates the magnetically sensitive component. The first member can be attached to the transom of a boat approximate the bottom or floor of the boat with the aperture extending through the transom.

In certain embodiments of the present invention, an alarm is connected in electrical communication with the magnetically sensitive component so that the alarm is activated if the second member is not in the predetermined position within the first member when an attempt is made to use the watercraft.

As described above, the warning system of the present invention does not utilize any additional moving components other than the drain plug which can be removed from the aperture and replaced therein. Therefore, the present invention eliminates many of the problems associated with known drain plug warning systems. Since it uses no moving parts to actuate its switch, debris in the bottom of the watercraft will not adversely affect its operation. Also, since the components of the present invention can be sealed within the first and second members of the system, corrosion can be virtually eliminated as a problem.

BRIEF DESCRIPTION OF THE DRAWINGS

The present invention will be more fully and clearly understood from a reading of the description of the preferred embodiment in conjunction with the drawings, in which.

DESCRIPTION OF PREFERRED EMBODIMENT

Figure 1:
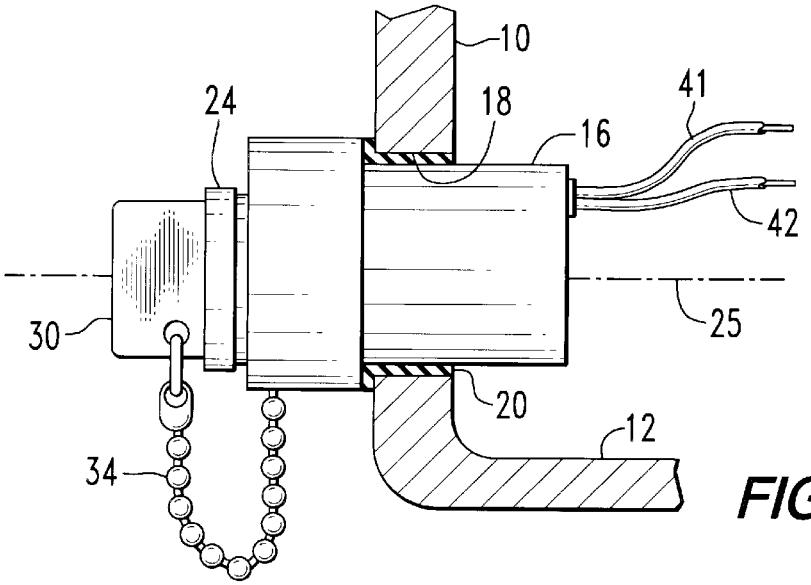
FIG. 1 shows the present invention attached to the transom of a watercraft.

Throughout the description of the preferred, like components will be identified by like reference numerals.

FIG. 1 shows the transom 10 of a watercraft with an opening formed therethrough near the bottom 12 portion of the watercraft. A first member 16 is attached to the transom 10 of the watercraft and has an aperture formed through its structure. The aperture formed through the first member 16 is not illustrated in FIG. 1, but will be described in greater detail below in conjunction with FIGS. 2, 3 and 4. The first member is inserted through the opening 18 in the transom 10 as shown in FIG. 1. A seal 20 prevents water from leaking through the opening 18 around the first member 16. A second member 24 is shaped to be received within the aperture of the first member 16 in order to prevent a fluid from flowing through the aperture of the first member 16.

In FIG. 1, the second member 24 is provided with an extension 30 that facilitates its being turned and handled by an operator. In order to prevent loss or misplacement of the second member 24, a short chain 34 attaches the second member 24 to the first member 16.

The watercraft can be drained by removing the second member 24 from the first member 16, thus opening the aperture which extends through the body of the first member 16. Water can then drain from the internal portion of the watercraft. After draining, the second member 24 is replaced in the aperture of the first member 16 to prevent water from passing through the aperture and therefore through the transom 10 of the watercraft.

With continued reference to FIG. 1, two electrical leads 41 and 42, are shown extending from the first member 16. As will be described in greater detail below, a sensor within the first member 16 is attached to the leads. The sensor can be a magnetically sensitive component, such as a Hall effect element, which is disposed within the structure of the first member 16.

Figure 2:
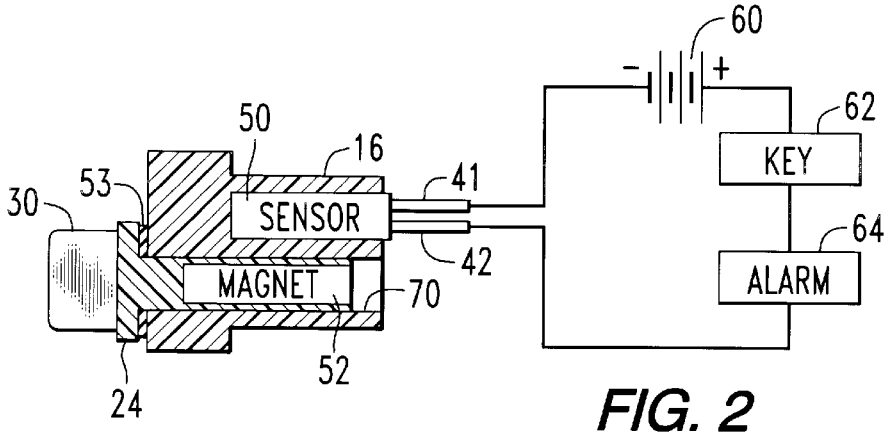
FIG. 2 is a section view of the drain plug structure of the present invention associated with an exemplary alarm circuit.

FIG. 2 shows a section view of the first member 16 and the second member 24. In the embodiment represented in FIG. 2, the sensor 50 is connected to the electrical leads, 41 and 42. It should be understood that the embodiment in FIG. 2 incorporates a sensor 50 which acts as a switch to represent the status of the alarm system. The status is typically binary in that the second member 24 is either in its proper place or it is not. The switch 50 can be either normally opened or normally closed, depending on the associated circuitry used in combination with the system.

A magnet 52 is shown embedded within the structure of the second member 24. In one type of embodiment, a permanent magnet 52 is disposed within the second member 24 and a Hall effect element 50 is disposed within the first member 16. However, it should be clearly understood that alternative configurations are also within the scope of the present invention. For example, the sensor 50 could comprise a Hall effect element with a biasing magnet disposed with it within the body of the first member 16. In this type of embodiment, a magnet is not needed within the structure of the second member 24. Instead, a ferromagnetic element can be attached to the second member 24 and the result is similar to the embodiment shown in FIG. 2. In both configurations, electrical conductors 41 and 42 can be disconnected or connected electrically from each other to complete a circuit based on the status of the sensor 50 which is responsive to the relative positions of the first member 16 and second member 24.

With continued reference to FIG. 2, the electrical conductors 41 and 42 are connected to a power source 60, a key operated mechanism 62, and an alarm device 64. It should be understood that the circuit in FIG. 2 is highly schematic and represents a very simple type of application of the present invention. If the sensor 50 is normally closed, the presence of the second member 24 in its predetermined location will activate the sensor 50 and it will open its switch. In other words, electrical conductors 41 and 42 will be disconnected from each other when the second member 24 is in its proper position within the aperture 70 of the first member 16. This will break the series circuit shown in FIG. 2 and the alarm 64 will not be provided with power from the battery 60 regardless of the status of the key mechanism 62. If, however, the second member 24 is removed from the aperture 70 that extends through the first member 16, the normally closed status of the sensor 50 will place electrical conductors 41 and 42 in electrical communication with each other to complete the circuit shown in FIG. 2 when the key mechanism 62 is activated. This activation of the key mechanism 62 will connect the alarm 64 to the battery 60 and provide power through the series circuit shown in the figure.

With continued reference to FIG. 2, it can be seen that no moving parts are required to detect the presence or absence of the second member 24 in relation to the first member 16. Therefore, the mechanism cannot be fouled by debris that can otherwise collect near the bottom of the watercraft.

Figure 3:
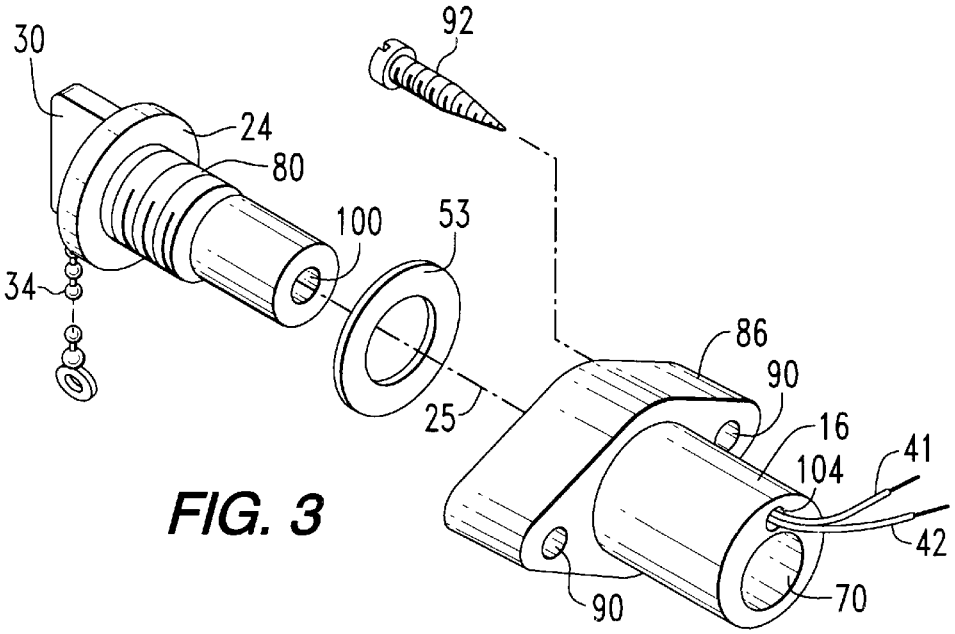
FIG. 3 is an exploded view of a drain plug and its housing made in accordance with the present invention.

FIG. 3 is an exploded view of the drain plug warning system of the present invention. The second member 24 is shown removed from the aperture 70 of the first member 16. In FIG. 3, the second member 24 or drain plug is provided with external threads 80 formed in its structure. Although not visible in FIG. 3, the first member 16 is provided with internal threads in the surface of its aperture 70 that allow the second member to be disposed in threaded association within the aperture 70 to place the second member 24 in the predetermined position that will activate the sensor 50 described above in conjunction with FIG. 2. Also shown in FIG. 3 is the seal 18 which can be a washer to prevent water from leaking around the threads 80 and through the aperture 70.

The first member 16 is provided with a mounting bracket portion 86 that facilitates its attachment to the transom 10 of a boat. It should be understood that many different ways for attaching the device to a boat are possible and are within the scope of the invention. One specific method for attachment is illustrated in FIG. 3 which comprises the bracket 86. The bracket is provided with holes 90 into which screws, such as screw 92, can pass to permit the bracket 86 to be rigidly attached to the transom. Also shown in FIG. 3 is an opening 100 formed in the second member 24 for the purpose of receiving the magnet 52 as described above in conjunction with FIG. 2. The sensor 50 is disposed within an opening 104 formed in the first member 16 to receive the sensor 50 as described above in conjunction with FIG. 2.

Figure 4:
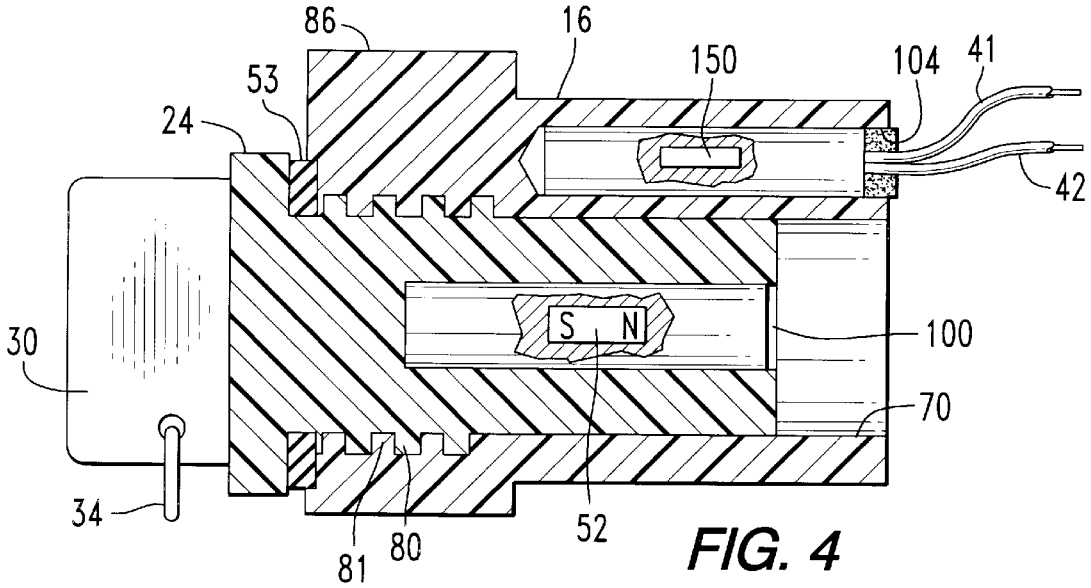
FIG. 4 is a sectional view of a drain plug threaded into its housing and showing both a permanent magnet in the drain plug and a magnetically sensitive component near the aperture of the housing.

FIG. 4 is a section view showing the drain plug warning system of the present invention. In the section view, the external threads 80 formed in the second member 24 can be shown in threaded association with the internal threads 81 formed in the aperture 70 of the first member 16. Also, a Hall effect element 150 is shown providing the magnetic sensitivity for the sensor 50 described above in conjunction with FIG. 2. A permanent magnet 52 is shown embedded in a potting material within the opening 100 formed in the second member 24. A similar potting material is used to contain the Hall effect element 150 within the opening 104 formed in the first member 16. When the second member 24 is properly threaded into the aperture 70 to a predetermined position, the magnet 52 affects the magnetically sensitive components, or Hall effect element 150, and activates the switch. Whether the Hall effect element 150 and associated circuitry create a switch that is normally opened or normally closed, its status is changed when the magnet 52 reaches the predetermined position within the aperture 70. Those skilled in the art will recognize that this status change can be accommodated to prevent the sounding of the alarm when the second member 24 is in the predetermined position within the first member 16, whether it is normally opened or normally closed. In addition, those skilled in the art are aware that many different types of Hall effect elements are commercially available with associated circuitry to use the Hall effect elements as a switch with a binary output. These devices are commercially available from the MICRO SWITCH Division of Honeywell Incorporated.

Figure 5:
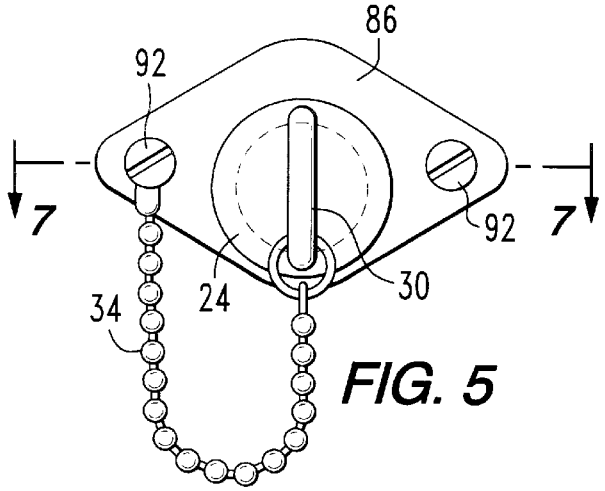
FIGS. 5 and 6 show front and back views, respectively, of a drain plug made in accordance with the present invention.

FIG. 5 shows a front view of the present invention when viewed from the left side of FIG. 4. The mounting bracket 86 is shown with two screws 92, inserted into its openings 90, as described above in conjunction with FIG. 3. The extension 30 of the second member 24 is connected to one of the screws 92 by a chain 34.

Figure 6:
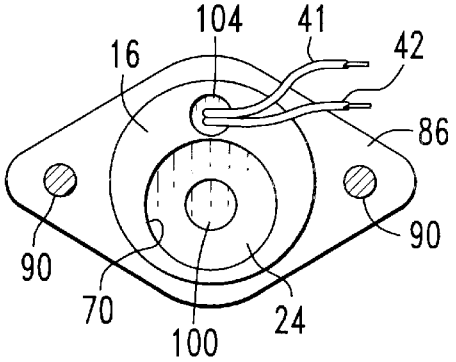

FIG. 6 shows an opposite end view of the present invention taken from the right side of FIG. 4. The second member 24 is shown disposed within the aperture 70 of the first member 16. Opening 100 in the second member 24 and opening 104 in the first member 16 can also be seen in FIG. 6. The mounting bracket 86 is provided with two holes 90 to receive the screws 92 described above in conjunction with FIG. 5. Electrical conductors 41 and 42 are also shown in FIG. 6 extending from the sensor, or Hall effect element, which is disposed within opening 104 of the first member 16.

Figure 7:
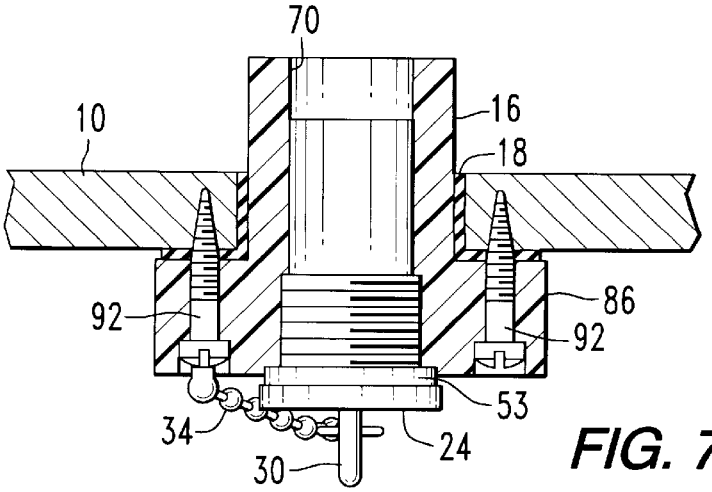
FIG. 7 shows a sectional view of a drain plug disposed within an aperture of a housing member attached to a transom of a watercraft.

FIG. 7 is a section view of FIG. 5. In it the first member 16 is shown extending through an opening in the transom 10 and the seal 18 is shown at the interface between the first member 16 and the opening. Two screws 92, extending through bracket 86, attach the first member 16 to the transom. The second member 24 is disposed within the aperture 70 extending through the first member 16. It can be seen that if the second member 24 is unthreaded from its association with the threads formed in the aperture 70, the aperture 70 will provide a passage through the transom 10 through which water can flow. The plug, or second member 24, can therefore be removed to allow water to flow out of the boat or personal watercraft with which the system is associated. After the draining procedure is completed, the plug should be replaced to block and seal the aperture 70 through the first member 16. However, if the operator forgets to replace the plug or second member 24, the magnet within the second member 24 will not be moved into actuating position relative to the sensor 50 because the second member 24 will not be moved into its predetermined location within the aperture 70. As a result, the alarm will sound when the operator activates the key switch.

The present invention provides a system that alerts a boat operator when the drain plug is not replaced prior to use of the watercraft. In certain circumstances, the present invention can be used in conjunction with a power source, a key switch mechanism and an alarm. However, it should be understood that many other arrangements are possible within the scope of the present invention. In addition, it should be understood that the magnetically sensitive component can comprise various types of technology other than a Hall effect element. Various other materials, including but not limited to indium antimonide, exhibit characteristics that allow those materials to be used in a magnetic field sensing application. In addition, it should be understood that the particular location in which the present invention is located within the structure of the watercraft is not limiting to the present invention.

I claim:

1. A drain plug warning system for a watercraft, comprising:

a generally cylindrical first member attached to said watercraft, said first member having an aperture formed therethrough;

a second member shaped to be received within said aperture to prevent a fluid from flowing through said aperture;

a magnetically sensitive component embedded within a wall of said generally cylindrical first member proximate said aperture; and an actuator embedded within said second member for actuating said magnetically sensitive component when said second member is disposed in a predetermined position within said aperture of said first member to actuate said magnetically sensitive component when said second member is in said aperture to prevent said fluid from flowing through said aperture.

2. The system of claim 1, wherein:

said actuator comprises a magnet attached to said second member.

3. The system of claim 2, wherein:

said aperture is threaded with internal threads, said second member is threaded with external threads, and said second member is disposable in threaded association within said aperture to place said second member in said predetermined position.

4. The system of claim 3, wherein:

said first member is attached to a transom of a boat proximate the bottom of said boat with said aperture extending through said transom.

5. The system of claim 4, wherein:

said magnetically sensitive component is a Hall effect device.

6. The system of claim 5, further comprising:

an alarm connected in electrical communication with said magnetically sensitive component, whereby said alarm is activated if said second member is not in said predetermined position within said first member when an attempt is made to use said watercraft.

7. A drain plug warning system for a watercraft, comprising:

a generally cylindrical first member attached to said watercraft, said first member having an aperture formed therethrough;

a second member shaped to be received within said aperture to prevent a fluid from flowing through said aperture;

a magnetically sensitive component embedded within a wall of said generally cylindrical first member and disposed proximate said aperture; and an actuator embedded within said second member for actuating said magnetically sensitive component when said second member is disposed in a predetermined position within said aperture of said first member to actuate said magnetically sensitive component when said second member is in said aperture to prevent said fluid from flowing through said aperture, said actuator comprising a magnet.

8. The system of claim 7, wherein:

said aperture is threaded with internal threads, said second member is threaded with external threads, and said second member is disposable in threaded association within said aperture to place said second member in said predetermined position.

9. The system of claim 7, wherein:

said first member is attached to a transom of a boat proximate the bottom of said boat with said aperture extending through said transom.

10. The system of claim 7, wherein:

said magnetically sensitive component is a Hall effect device.

11. The system of claim 7, further comprising:

an alarm connected in electrical communication with said magnetically sensitive component, whereby said alarm is activated if said second member is not in said predetermined position within said first member when an attempt is made to use said watercraft.

12. A drain plug warning system for a watercraft, comprising:

a first member attached to said watercraft, said first member being generally cylindrical and having an aperture formed therethrough;

a second member shaped to be received within said aperture of said generally cylindrical first member to prevent a fluid from flowing through said aperture;

a magnetically sensitive component embedded within a wall of said generally cylindrical first member and disposed proximate said aperture; and an actuator embedded within the body of said second member for actuating said magnetically sensitive component when said second member is disposed in a predetermined position within aperture of said first member to prevent a fluid from flowing through said aperture, said actuator comprising a magnet, said aperture being threaded with internal threads, said second member being threaded with external threads, and said second member being disposable in threaded association within said aperture to place said second member in said predetermined position to prevent said fluid from flowing through said aperture and actuate said magnetically sensitive component to indicate that said second member is in position to prevent said fluid from flowing through said actuator.

13. The system of claim 12 wherein:

said first member is attached to a transom of a boat proximate the bottom of said boat with said aperture extending through said transom.

14. The system of claim 12, wherein:

said magnetically sensitive component is a Hall effect device.

15. The system of claim 12, further comprising:

an alarm connected in electrical communication with said magnetically sensitive component, whereby said alarm is activated if said second member is not in said predetermined position within said first member when an attempt is made to use said watercraft.

* * * * *